US008479410B2

(12) United States Patent
Jung et al.

(10) Patent No.: US 8,479,410 B2
(45) Date of Patent: Jul. 9, 2013

(54) DRYER AND A CONTROL METHOD THEREOF

(75) Inventors: Ki-Wook Jung, Gyeongsangnam-Do (KR); Jun-Seok Lee, Gyeongsangnam-Do (KR)

(73) Assignee: LG Electronics Inc., Seoul (KR)

( * ) Notice: Subject to any disclaimer, the term of this patent is extended or adjusted under 35 U.S.C. 154(b) by 413 days.

(21) Appl. No.: 12/935,227

(22) PCT Filed: Jun. 2, 2009

(86) PCT No.: PCT/KR2009/002934

§ 371 (c)(1),
(2), (4) Date: Sep. 28, 2010

(87) PCT Pub. No.: WO2009/148250

PCT Pub. Date: Dec. 10, 2009

(65) Prior Publication Data

US 2011/0016743 A1 Jan. 27, 2011

(30) Foreign Application Priority Data

Jun. 3, 2008 (KR) ..... 10-2008-0052326

(51) Int. Cl.
*F26B 7/00* (2006.01)

(52) U.S. Cl.
USPC ..... 34/428; 34/493; 34/554; 34/603; 219/483; 219/538

(58) Field of Classification Search
USPC ..... 34/428, 493, 554, 595, 601, 603; 68/5 R, 68/19 R; 8/137; 219/400, 483, 538
See application file for complete search history.

(56) References Cited

U.S. PATENT DOCUMENTS

| | | | | | |
|---|---|---|---|---|---|
| 1,786,191 | A | * | 12/1930 | Carroll | 34/485 |
| 2,142,042 | A | * | 12/1938 | Bowdoin et al. | 34/486 |
| 2,796,679 | A | * | 6/1957 | Dunkelman | 34/547 |
| 2,842,864 | A | * | 7/1958 | Warhus | 34/546 |
| 2,851,791 | A | * | 9/1958 | Olthuis | 34/90 |
| 3,196,553 | A | * | 7/1965 | Deaton et al. | 34/534 |
| 3,397,461 | A | * | 8/1968 | Fogt et al. | 34/527 |
| 3,409,994 | A | * | 11/1968 | Menk | 34/499 |
| 4,195,415 | A | * | 4/1980 | Livings et al. | 34/549 |
| 4,231,166 | A | * | 11/1980 | McMillan | 34/553 |
| 2005/0086824 | A1 | * | 4/2005 | Ono et al. | 34/62 |
| 2006/0053651 | A1 | * | 3/2006 | Tadano et al. | 34/74 |
| 2006/0218816 | A1 | * | 10/2006 | Wunderlich | 34/549 |
| 2008/0000098 | A1 | * | 1/2008 | Choi et al. | 34/114 |
| 2011/0062145 | A1 | * | 3/2011 | Yang et al. | 219/538 |
| 2012/0324755 | A1 | * | 12/2012 | Zhao | 34/427 |

FOREIGN PATENT DOCUMENTS

| | | | | |
|---|---|---|---|---|
| DE | 3626391 | A1 | * | 2/1988 |
| JP | 02159300 | A | * | 6/1990 |
| JP | 09225196 | A | * | 9/1997 |
| JP | 10-211383 | A | | 8/1998 |
| JP | 2001-198388 | A | | 7/2001 |
| JP | 2011167428 | A | * | 9/2011 |
| KR | 20-0339104 | Y1 | | 1/2004 |
| KR | 10-0751133 | B1 | | 8/2007 |

* cited by examiner

*Primary Examiner* — Steve M Gravini
(74) *Attorney, Agent, or Firm* — Birch, Stewart, Kolasch & Birch, LLP

(57) ABSTRACT

A dryer control method includes: a first dry step of drying a dry item with strong hot wind while tumbling a drum in which the dry item is placed; and a second dry step of drying the dry item with mild hot wind while tumbling the drum. Because the dry process is repeatedly performed on the dry item according to a proposed dry algorithm, the dry item made of wool fiber can be prevented from being shrunken or creased in the dry process.

13 Claims, 5 Drawing Sheets

DRYER AND A CONTROL METHOD THEREOF

TECHNICAL FIELD

The present invention relates to a dryer and its control method, and more particularly, to a dryer capable of drying a dry item made of wool fiber with strong hot wind and mild hot wind while tumbling a drum accommodating the dry item to thereby prevent the dry item from being shrunken or creased during a dry process.

BACKGROUND ART

In general, a dryer, a home appliance devised for drying the laundry, i.e., mainly the clothes, which have been washed, by using air, includes a drum for accommodating dry items, a driving source for drying the drum, a heating unit for heating air introduced into the drum, and a blower unit for sucking air from the interior of the drum or discharging it.

The dryer may be classified into various types according to a discrimination basis. First, the dryer may be classified into an electric dryer and a gas dryer according to how air is heated, namely, according to a heating unit. The electric dryer heats air by using electric resistance heat, and the gas dryer heats air by using heat generated by combustion of gas.

Also, the dryer may be classified into a condensation type dryer and an exhaustion type dryer according to how humid generated as dry items are dried is treated. In the condensation type dryer, air which has been humid as it heat-exchanged with the dry items in the drum is circulated, rather than being discharged to the outside, and a condenser is heat-exchanged with external air to create and discharge condensation water to the outside. In the exhaust type dryer, air which has been heat-exchanged with the dry item so as to include high moisture is directly discharged to the outer side of the dryer.

In addition, the dryer may be classified into a top loading type dryer and a front loading type dryer depending on how a dry item is input into the dryer. In the top loading type, a dry item is inputted from the upper side of the dryer, and in the front loading type, a dry item is inputted from a front side of the dryer.

The related art dryer is a device for drying dry items by using heat of high temperature irrespective of a classification type.

In this case, however, a time duration during which each dry item comes in contact with high temperature air needs to be different and an air temperature range should be different according to their types. Namely, if the air temperatures or contact time durations are equal, the dry items might be severely thermally damaged or severely creased depending on the materials of the dry items.

Thus, if the dry items accommodated within the drum of the related art dryer are fiber made of wool fiber, a time duration during which the dry item is exposed to hot wind at high temperature is very long, thermally damaging the dry item, and severely shrinking the dry items.

TECHNICAL GIST OF THE PRESENT INVENTION

Therefore, it is an object of the present invention to provide a dryer capable of preventing a dry item made of a wool material from being severely shrunken as it is brought into contact with hot wind in a dry step by tumbling a drum in which the dry item is placed together with supplying of hot wind, and its control method.

It is another object of the present invention to provide a dryer capable of preventing a dry item made of a wool material from being creased by performing a cooling operation during a certain time at a termination step of a dry process, and its control method.

To achieve the above objects, there is provided a dryer control method including: a first dry step of drying a dry item with strong hot wind while tumbling a drum in which the dry item is placed; and a second dry step of drying the dry item with mild hot wind while tumbling the drum.

The first dry step may include: a strong hot wind supply step of supplying strong hot wind by a high capacity heater to the interior of the drum while tumbling the drum; and a strong hot wind interruption step of interrupting the supply of strong hot wind to cool the dry item.

The second dry step may include: a mild hot wind supply step of supplying mild hot wind by a low capacity heater to the interior of the drum while tumbling the drum; and a mild hot wind interruption step of interrupting the supply of mild hot wind to cool the dry item.

The first and second dry steps may be controlled according to the temperature of discharged hot wind, and preferably, the first and second dry steps may be controlled based on an execution time duration of the first and second dry steps.

The first and second dry steps may further include: a time measurement step of detecting an execution time duration of each step; and a temperature detection step of measuring the temperature of hot wind discharged in each step.

The strong hot wind supply step may continue until such time as the detected temperature of the hot wind increases to a first reference temperature or until such time as the measured tumbling time duration reaches a first reference time.

The strong hot wind interruption step may continue until such time as the detected temperature of hot wind drops to a second reference temperature or until such time as the measured tumbling time duration reaches a second reference time.

The mild hot wind supply step may continue until such time as the detected temperature of hot wind drops to a second reference temperature or until such time as the measured execution time duration reaches a second reference time.

The mild hot wind interruption step may continue until such time as the detected temperature of hot wind drops to a second reference temperature or until such time as the measured execution time duration reaches a second reference time.

The control method may further include: a display step of displaying the execution time duration of each step or the temperature of the discharged hot wind; and a crease removal step of cooling the dry item after the second dry step to remove a crease.

To achieve the above objects, there is also provided a dryer, which includes a drum, a heater unit, a blow fan for supplying hot wind generated by the heater unit to the drum, and a motor for driving the drum and the blow fan, including: a controller configured to control the heater unit and the motor to repeatedly dry a dry item accommodated within the drum with strong hot wind and mild hot wind while tumbling the drum.

The controller may control the heater and the motor to cool the dry item during a pre-set time period to remove a crease.

The heater unit may include a high capacity heater and a low capacity heater.

The controller may control an ON/OFF operation of the heater and motor according to the temperature of hot wind. Preferably, the controller controls an ON/OFF operation of the heater and the motor according to the hot wind temperature and a time duration during which each stroke of the dryer is performed.

According to the dryer and its control method, because the strong hot wind dry step and the mild hot wind dry step are performed to supply hot wind to the dry item received within the drum and cooling the dry item while tumbling the drum, the dry item made of wool fiber can be dried without a shrinkage.

In addition, because the dry item made of wool fiber is cooled after the termination of the dry step, a crease generated in the dry item can be removed.

MODE FOR CARRYING OUT THE PREFERRED EMBODIMENTS

Exemplary embodiments of the present invention will now be described in detail with reference to the accompanying drawings.

In order to describe a dryer according to an exemplary embodiment of the present invention, a front loading type dryer, an electric type dryer and a condenser type drier will be taken as examples. However, the present invention is not limited thereto and can be also applicable to a top loading type dryer, a gas type drier, and the like.

The dryer according to an exemplary embodiment of the present invention will now be described in detail with reference to FIGS. 1 and 2.

Figure 1:
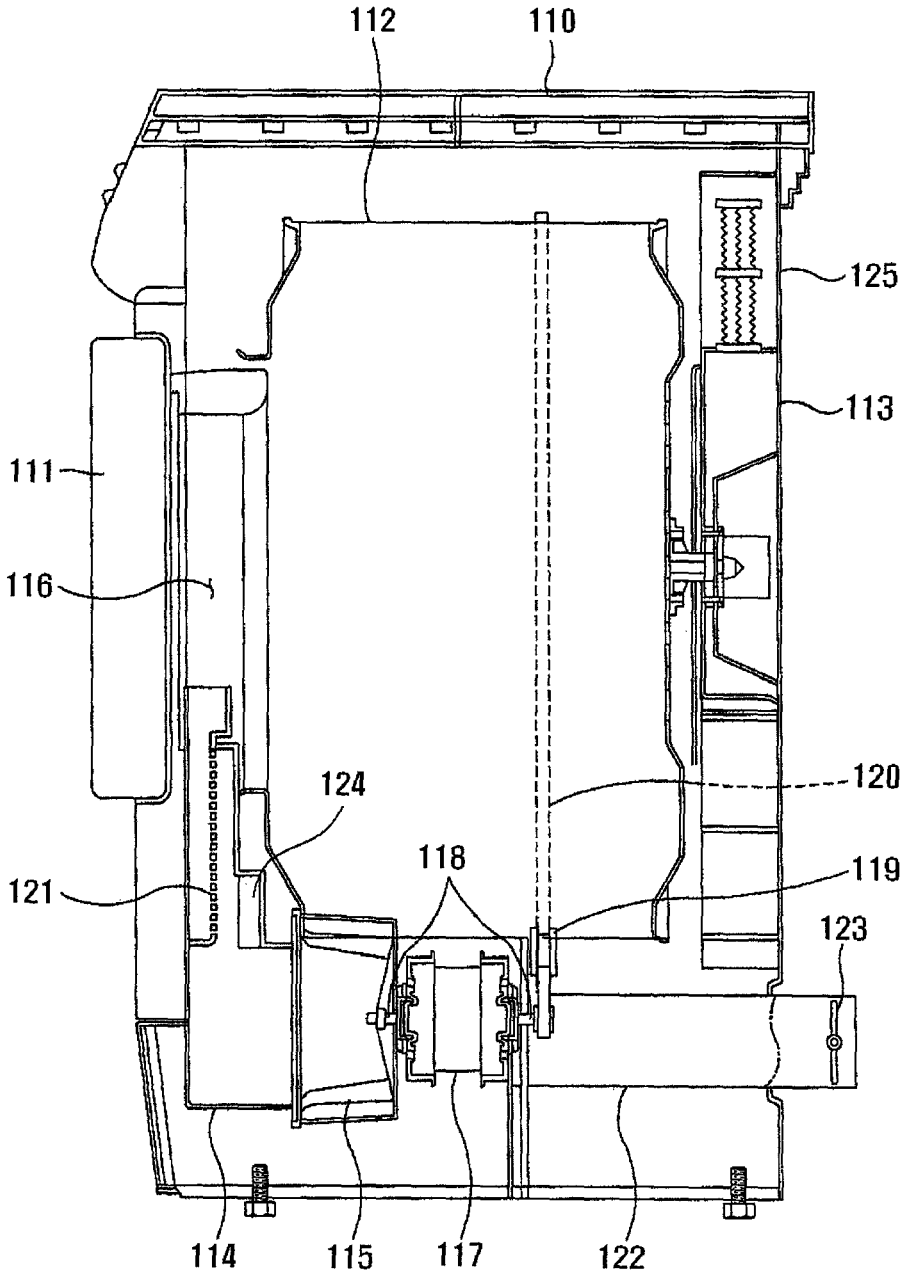
FIG. 1 is a sectional view of a dryer according to an exemplary embodiment of the present invention.
Figure 2:
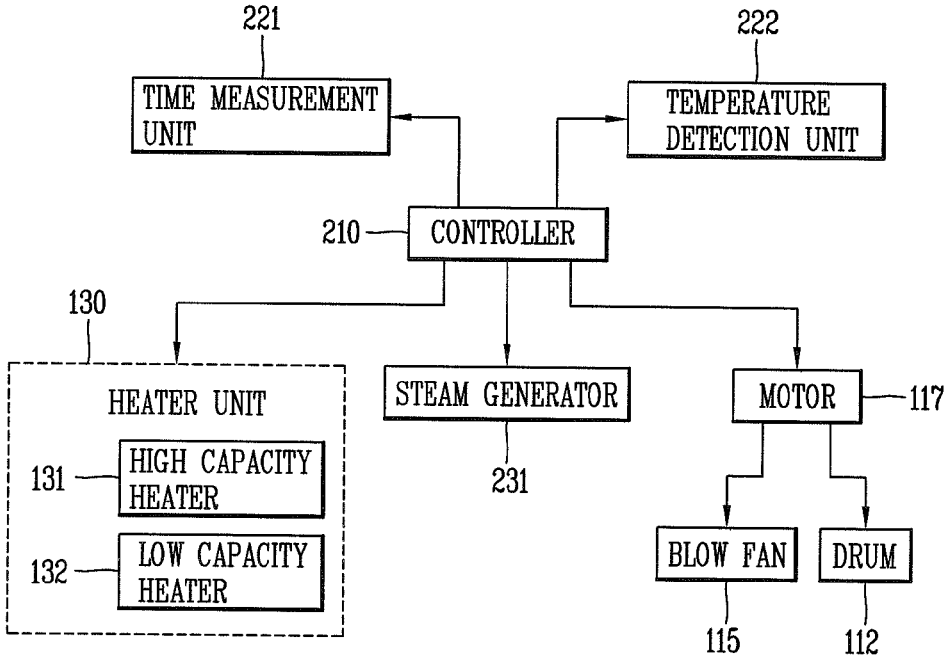
FIG. 2 is a schematic block diagram of a controller of the dryer according to an exemplary embodiment of the present invention.

FIG. 1 is a sectional view of a dryer according to an exemplary embodiment of the present invention, and FIG. 2 is a schematic block diagram of a controller of the dryer according to an exemplary embodiment of the present invention.

As shown in FIG. 1, the dryer includes a cabinet 110 constituting an outer appearance of the dryer and having a door 111 formed on a front surface thereof, a drum 112 installed to be rotatable within the cabinet 110, a hot wind guide duct 113 for guiding hot wind into the drum 112, a hot wind discharge duct 114 for discharging hot wind which has passed through the interior of the drum 112, a blow fan 115 for sucking external air and discharging it, and a temperature detecting unit 222 for detecting the temperature of hot wind discharged via the hot wind discharge duct 114.

An opening 16 is formed on the front surface of the cabinet 110 with the door 111 mounted thereon in order to allow clothes to be input into the drum 112 or taken out of the rum 112. The drum 112 is rotated at a low speed by a motor 117 installed at a lower portion of the cabinet 110. The motor 117 is provided to simultaneously drive the drum 112 and the blow fan 115, for which a driving shaft 118 of the motor 117 extends to both sides of the motor 117. One end of the driving shaft 118 is connected to the blow fan 115, and the other end is connected to a pulley 119 to rotate the drum 112. A belt 120, installed to cover the drum 112, is connected to the pulley 119.

The hot wind discharge duct 114 is disposed between a lower portion of the front surface of the drum 112 and the blow fan 115. A filter 121 is installed at one end of the hot wind discharge duct 114 to filter out debris such as nap or the like included in the hot wind which has passed through the drum 112. An exhaust duct 122 is formed as a cylindrical pipe at an outlet of the blow fan 115. An opening end of the exhaust duct 122 extends to outside of the cabinet 110. A switching valve 123 is installed at the opening end of the exhaust duct 122 to open the exhaust duct 122 by hot wind when the blow fan 115 is operated. When the blow fan 115 is not operated, the exhaust duct 122 is closed to prevent an introduction of debris from the exterior.

A heater unit 125 is installed at an upper portion of the hot wind guide duct 113. As the blow fan 115 and the drum 112 are rotated according to driving of the motor 117, external air, passing through the heater unit 125, is heated and introduced into the drum 112 via the hot wind guide duct 113. Accordingly, the clothes placed within the drum 112 is dried by the hot wind, and the hot wind which has passed through the drum 112 is discharged to the outside via the hot wind discharge duct 114 and the exhaust duct 122.

The heater unit 125 includes a high capacity heater 131 of 1750 W and a low capacity heater 132 of 750 W.

A steam generator (which is called a container heating method) that generates steam by heating a certain amount of water housed in a water tank (not shown) is installed at a certain position of the cabinet 110. However, in the present invention, any device can be used as a steam generator so long as it can generate steam. For example, a heater may be directly installed at the circumference of a water supply hose through which water passes, to heat water (which is called a tube heating method), rather than housing water in a certain space.

The controller 210 will now be described in detail with reference to FIG. 2.

The controller 210 is provided at a certain position of the dryer according to an exemplary embodiment of the present invention and controls the motor 117 and the heater 125 to adjust hot wind supply and cooling with respect to dry items. A time measurement unit 221 is provided to measure a time duration of a hot wind supply and cooling process. A temperature detecting unit 222 is provided to detect the temperature of hot wind discharged from the drum 112.

The temperature detecting unit 222 is provided at a certain position of the hot wind discharge duct 114 to detect the temperature of hot wind discharged through the hot wind discharge duct 114. The time measurement unit 221 measures a time duration during which hot wind generated by the heater unit 125 is supplied to the interior of the drum 112 and a time duration during which the dry items within the drum are cooled. The controller 210 controls the heater unit 125, the blow fan 115 and the motor 117 based on the information collected from various elements of the dryer including the detected temperature, the measured time duration, and the like, to thus control the operation of the dryer.

The temperature detecting unit 222 detects the temperature of the hot wind discharged from the drum 112. The controller controls ON/OFF operation of the heater 125 according to the results obtained by determining whether or not the detected temperature is a value within a pre-set temperature range. The time measurement unit 221 measures a time duration during which the hot wind generated by the heater 125 is supplied to the interior of the drum 112. The controller 210 controls a processing procedure with respect to the dry items based on the results obtained by comparing the measured time duration or the detected temperature with the pre-set time duration or the pre-set temperature range.

The controller 210 controls the dryer by performing a step of tumbling the drum 112 with the dry item accommodated therein by supplying strong hot wind, and a step of tumbling the drum 112 with the dry item accommodated therein by supplying mild hot wind.

In case of controlling the dryer with strong hot wind, the controller 210 turns on a high capacity heater 131 of 1750 W and forwardly rotates the blow fan 115 to supply strong hot wind to the interior of drum 112 and, at the same time, controls the motor 117 to tumble the drum 112 with the dry item placed therein.

In case of controlling the dryer with mild hot wind, the controller 210 turns on a low capacity heater 131 of 750 W and forwardly rotates the blow fan 115 to supply mild hot wind to the interior of drum 112 and, at the same time, controls the motor 117 to tumble the drum 112 with the dry item placed therein.

When the strong hot wind dry step and the mild hot wind dry step are terminated, the controller 210 controls the dryer to cool the dry item in order to prevent the dry item, which has undergone the dry steps, from being creased.

The dryer may include a display unit for displaying an execution time period of each step or the temperature of discharged hot wind.

In the present exemplary embodiment, the temperature detection unit 222 is positioned at the hot wind discharge duct 114, but without being limited thereto, the temperature detecting unit 222 may be also provided at the hot wind guide duct 113 or the drum 112. More preferably, the temperature detecting unit 222 is provided at the interior of the drum 112 to directly measure the internal temperature of the drum 112.

A dryer control method according to an exemplary embodiment of the present invention will now be described with reference to FIGS. 3 to 7.

Figure 3:
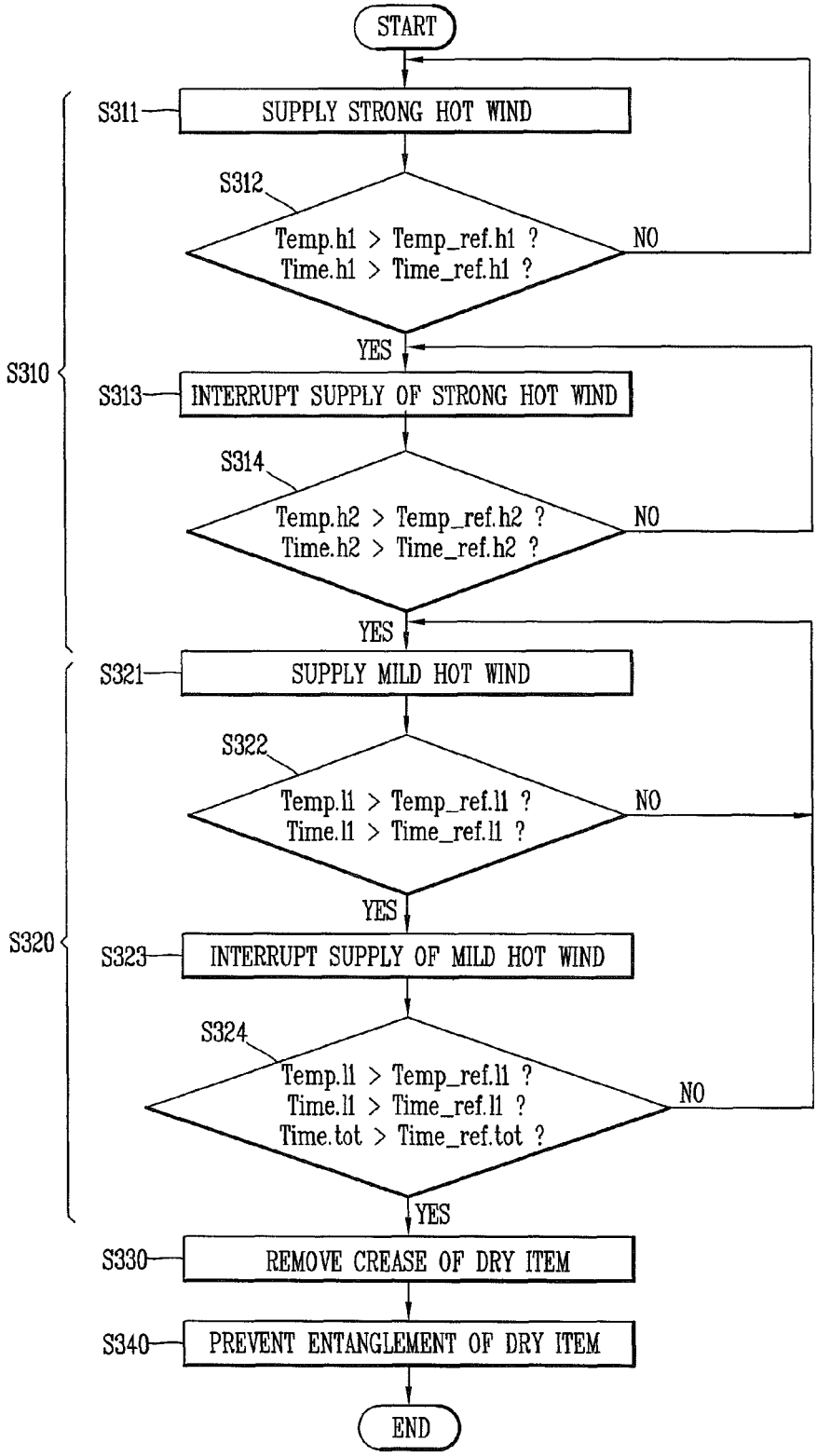
FIG. 3 is a flow chart illustrating the process of a dryer control method according to an exemplary embodiment of the present invention.
Figure 4:
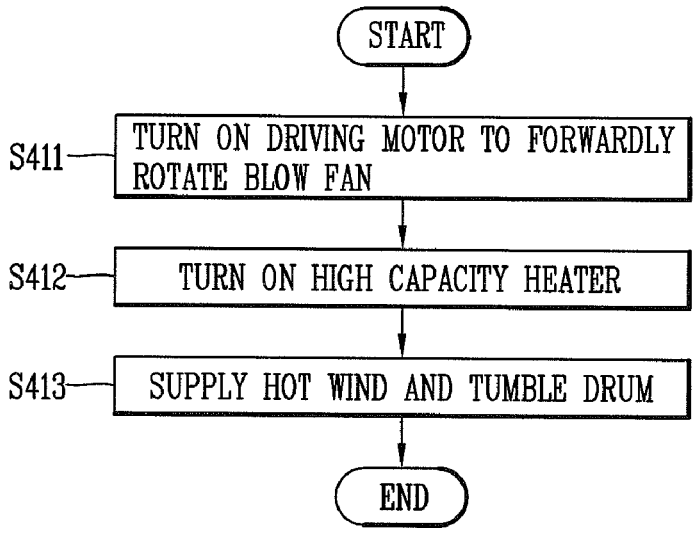
FIG. 4 is a flow chart illustrating the process of controlling a motor and heater to dry a dry item made of a wool material by supplying strong hot wind and tumbling the drum according to an exemplary embodiment of the present invention.
Figure 5:
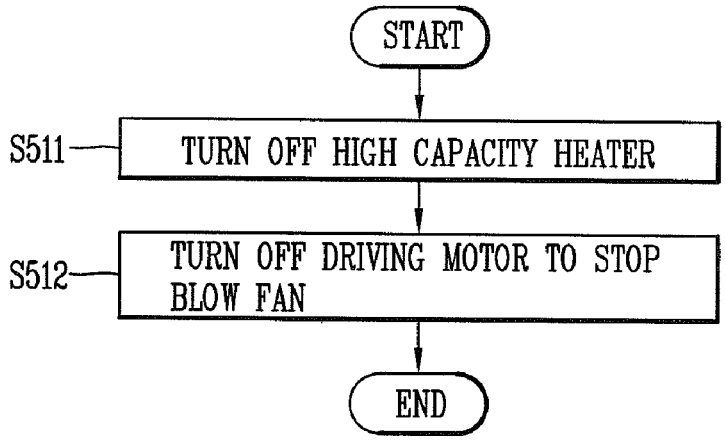
FIG. 5 is a flow chart illustrating the process of controlling the motor and the heater to terminate the strong hot wind dry step according to an exemplary embodiment of the present invention.
Figure 6:
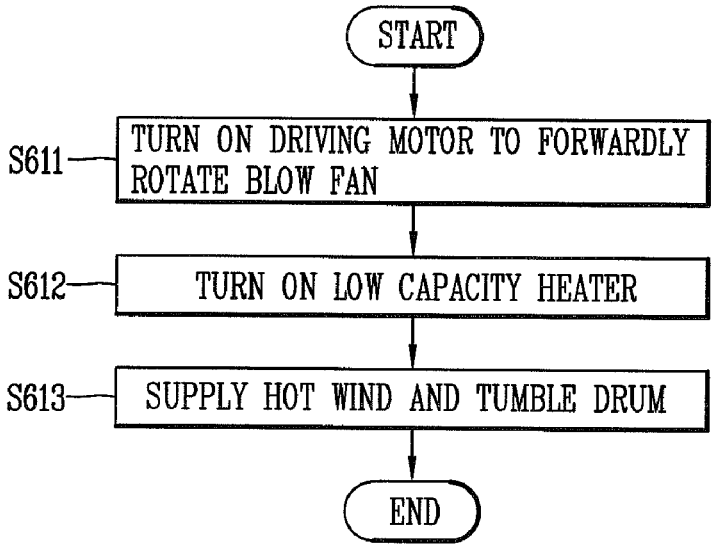
FIG. 6 is a flow chart illustrating the process of controlling a motor and heater to dry a dry item made of a wool material by supplying mild hot wind and tumbling the drum according to an exemplary embodiment of the present invention.
Figure 7:
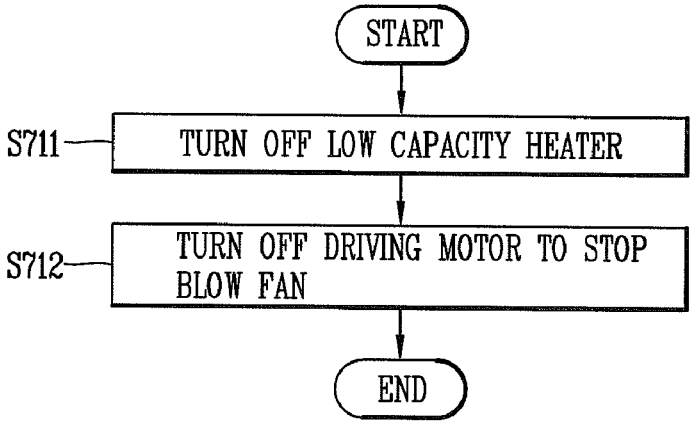
FIG. 7 is a flow chart illustrating the process of controlling the motor and the heater to terminate the mild hot wind dry step according to an exemplary embodiment of the present invention.

FIG. 3 is a flow chart illustrating the process of a dryer control method according to an exemplary embodiment of the present invention, FIG. 4 is a flow chart illustrating the process of controlling a motor and heater to dry a dry item made of a wool material by supplying strong hot wind and tumbling the drum according to an exemplary embodiment of the present invention, FIG. 5 is a flow chart illustrating the process of controlling the motor and the heater to terminate the strong hot wind dry step according to an exemplary embodiment of the present invention, FIG. 6 is a flow chart illustrating the process of controlling a motor and heater to dry a dry item made of a wool material by supplying mild hot wind and tumbling the drum according to an exemplary embodiment of the present invention, and FIG. 7 is a flow chart illustrating the process of controlling the motor and the heater to terminate the mild hot wind dry step according to an exemplary embodiment of the present invention.

The dryer control method according to an exemplary embodiment of the present invention includes: a first dry step (S310) of drying the dry item with strong hot wind while tumbling the drum in which the dry item is placed; and a second dry step (S320) of drying the dry item with mild hot wind while tumbling the drum.

Here, the first and second dry steps may be controlled according to the temperature of hot wind.

The first dry step includes a strong hot wind supply step (S311) of supplying strong hot wind and a strong hot wind interruption step (S313) of interrupting the supply of strong hot wind, and the second dry step includes a mild hot wind supply step (S321) of supplying mild hot wind and a mild hot wind interruption step (S323) of interrupting the supply of mild hot wind.

When the strong hot wind supply step starts, the controller 210 turns on the motor 117 to forwardly rotate the blow fan 115 (S411) and turns on the high capacity heater 131 of 1750 W (S412). Then, the blow fan 115 supplies strong hot wind generated by the high capacity heater 131 to the interior of the drum 112 and, at the same time, the controller 210 tumbles the drum 112 (S311).

The strong hot wind supply step is maintained until such time as the temperature (Temp.h1) of the strong hot wind or an execution time duration (Time.h1) for the strong hot wind supplying and tumbling operations reaches a reference temperature (temp_ref.h1) or a reference time (Time_ref.h1) (S312).

Here, the reference temperature (temp_ref.h1) is 43° C., and the reference time (Time_ref.h1) is four minutes.

After the step of supplying the strong hot wind is terminated, when the strong hot wind interruption step starts, the controller 210 turns off the high capacity heater 131 and the motor 117 (S511 and S512). The strong hot wind interruption step is maintained until such time as the strong hot wind temperature (Temp.h2) or the execution time duration (Time.h2) reaches the reference temperature (temp_ref.h2) or the reference time (Time_ref.h2) (S314).

Here, the reference temperature (temp_ref.h2) is 35° C., and the reference time (Time_ref.h2) is three minutes.

When the mild hot wind supply step starts, the controller 210 turns on the motor 117 to forwardly rotate the blow fan 115 (S611) and turns on the low capacity heater 132 of 750 W (S612). Then, the blow fan 115 supplies mild hot wind generated by the low capacity heater 132 to the interior of the drum 112 and, at the same time, the controller 210 tumbles the drum 112 (S321).

The strong hot wind supply step is maintained until such time as the temperature (Temp.l1) of the mild hot wind or an execution time duration (Time.l1) for the mild hot wind supplying and tumbling operations reaches a reference temperature (temp_ref.l1) or a reference time (Time_ref.h1) (S322).

Here, the reference temperature (temp_ref.l1) is 43° C., and the reference time (Time_ref.l1) is four minutes.

After the step of supplying the mild hot wind is terminated, when the mild hot wind interruption step starts, the controller 210 turns off the low capacity heater 132 (S711) and the motor 117 for driving the blow fan 115

(S712). The mild hot wind interruption step is maintained until such time as the mild hot wind temperature (Temp.l2) or the execution time duration (Time.l2) reaches the reference temperature (temp_ref.l2) or the reference time (Time_ref.l2), or until such time as a total operation time duration (Time.tot) of the first and second dry steps reaches a total reference operation time (Time_ref.tot) (S324).

Here, the reference temperature (Temp_ref.l2) is 35° C., and the reference time (Time_ref.l2) is three minutes. The prior-reference operation time duration (Time_ref.tot) is 21 minutes.

Preferably, the control method includes: a display step of displaying the execution time duration of each step or the temperature of the discharged hot wind; and a crease removal step of cooling the dry item after the second dry step to remove a crease.

Preferably, the crease removal step continues for one minute, and the dry item is wool fiber.

The invention being thus described, it will be obvious that the same may be varied in many ways. Such variations are not to be regarded as a departure from the scope of the invention, and all such modifications as would be obvious to one skilled in the art are intended to be included within the scope of the following claims.

The invention claimed is:

1. A dryer control method comprising:

a first dry step of drying a dry item with strong hot wind while tumbling a drum in which the dry item is placed; and a second dry step of drying the dry item with mild hot wind while tumbling the drum, wherein the first dry step comprises:

a strong hot wind supply step of supplying strong hot wind by a high capacity heater to the interior of the drum while tumbling the drum; and a strong hot wind interruption step of interrupting the supply of strong hot wind to cool the dry item, and the second dry step comprises:

a mild hot wind supply step of supplying mild hot wind by a low capacity heater to the interior of the drum while tumbling the drum; and a mild hot wind interruption step of interrupting the supply of mild hot wind to cool the dry item.

2. The method of claim 1, further comprising:

a time measurement step of detecting an execution time duration of each step; and a temperature detection step of measuring the temperature of hot wind discharged in each step.

3. The method of claim 2, wherein the strong hot wind supply step may continue until such time as the detected temperature of the hot wind increases to a first reference temperature or until such time as the measured tumbling time duration reaches a first reference time.

4. The method of claim 2, wherein the strong hot wind interruption step continues until such time as the detected temperature of hot wind drops to a second reference temperature or until such time as the measured tumbling time duration reaches a second reference time.

5. The method of claim 2, wherein the mild hot wind supply step continues until such time as the detected temperature of hot wind drops to a second reference temperature or until such time as the measured execution time duration reaches a second reference time.

6. The method of claim 2, wherein the mild hot wind interruption step continues until such time as the detected temperature of hot wind drops to a second reference temperature or until such time as the measured execution time duration reaches a second reference time.

7. The method of claim 2, wherein the second dry step is repeatedly performed until such time as a total execution time duration of the first and second dry steps reaches a total reference execution time.

8. The method of claim 1, further comprising:

a display step of displaying the execution time duration of each step or the temperature of the discharged hot wind.

9. The method of claim 1, further comprising:

a crease removal step of cooling the dry item after the second dry step to remove a crease.

10. The method of claim 1, wherein the dry item is wool fiber.

11. A dryer comprising:

a drum;

a heater unit including a high capacity heater and a low capacity heater;

a blow fan for supplying hot wind generated by the heater unit to the drum;

a motor for driving the drum and the blow fan; and a controller configured to control the heater unit and the motor to repeatedly dry a dry item accommodated within the drum with strong hot wind and mild hot wind while tumbling the drum, wherein the controller controls the high capacity heater to generate the strong hot wind and controls the low capacity heater to generate the mild hot wind.

12. The dryer of claim 11, wherein the controller controls the heater and the motor to cool the dry item during a pre-set time period to remove a crease.

13. The dryer of claim 11, wherein the controller controls an ON/OFF operation of the heater and motor according to the temperature of hot wind.

* * * * *